United States Patent [19]

Fuchs et al.

[11] 3,983,811

[45] Oct. 5, 1976

[54] MULTI-CYLINDER PRINTING PRESS AND CYLINDER BOW COMPENSATION SYSTEM

[75] Inventors: Boris Fuchs, Frankenthal; Ingo Köbler, Augsburg, both of Germany

[73] Assignee: Maschinenfabrik Augsburg-Nurnberg AG, Augsburg, Germany

[22] Filed: Apr. 30, 1975

[21] Appl. No.: 573,588

[30] Foreign Application Priority Data

May 10, 1974 Germany ..... 2422696

[52] U.S. Cl. ..... 101/216; 72/243; 100/162 B; 101/180; 226/194

[51] Int. Cl.[2] ..... B41L 35/12

[58] Field of Search.... 101/212, 216, 219, 178–181, 101/175; 100/162 B, 162 R, 155 R; 72/224, 242, 243; 226/194

[56] References Cited

UNITED STATES PATENTS

| | | | |
|---|---|---|---|
| 296,081 | 4/1884 | Steel | 101/216 X |
| 301,942 | 7/1884 | Wilson | 101/216 |
| 2,844,095 | 7/1958 | Harless | 101/180 |
| 3,256,812 | 6/1966 | Karrenbane | 101/216 |
| 3,288,337 | 11/1966 | Van Bergen et al. | 226/194 |
| 3,289,580 | 12/1966 | Dutro | 101/197 |
| 3,297,223 | 1/1967 | Bueker | 226/194 |
| 3,647,621 | 3/1972 | Schiel | 100/162 B |
| 3,798,950 | 3/1974 | Franek et al. | 72/241 |

*Primary Examiner*—Edgar S. Burr
*Assistant Examiner*—William Pieprz
*Attorney, Agent, or Firm*—Flynn & Frishauf

[57] ABSTRACT

To prevent center sag, or bowing of printing cylinders, and thus uneven printing throughout the axial length thereof, extension struts are connected to stub shafts at the ends of the cylinders, the struts being connected together to form a closed, rectangular or square frame in which the individual lengths of the struts are adjustable to thereby provide individually adjusted forces to the ends of the stub shafts and counteract sag or bow of the cylinders.

10 Claims, 9 Drawing Figures

MULTI-CYLINDER PRINTING PRESS AND CYLINDER BOW COMPENSATION SYSTEM

The present invention relates to printing machines, and more particularly to printing machines in which at least four cylinders are used which have shaft ends, or stub shafts, supported in bearings located at spaced support walls, the cylinders being so located that printing carriers can be looped thereabout.

Cylinders, or rollers, and particularly long cylinders or rollers which are held at their ends in bearings are subject to bending or bowing centrally of their axial length, particularly when these cylinders are pressed into engagement with each other. Differences in engagement pressure between the center portion and the end portion of engaging rollers are particularly annoying in printing machinery.

It has previously been proposed (see, for example, German Patent Publication DT-AS No. 2,035,515) to introduce a bending or bowing force in the form of a bending moment being applied to an extension shaft of the printing cylinder by applying forces acting counter the engagement pressure and at the outside of the bearings for the respective cylinder, for example by eccenter devices, or by hydraulically pressurized bias or engaging elements. The foregoing disclosure is directed to a single gravure printing system having a gravure cylinder and a single steel cylinder and a presser. Such a system cannot readily be applied to multi-cylinder printing apparatus, however, since it requires a great number of apparatus, a multiplicity of setting elements or devices, and heavy, bulky supports and mutual force absorbing beams or struts, which greatly interfere with the accessibility and appearance of the side wall of the machine.

It is an object of the present invention to so construct a multi-cylinder printing press in a simple and reliable manner and which, additionally, is so constructed that the cylinders are prevented from axial bowing, so that the pressure applied by the cylinders is approximately even over their entire axial length, so that the eventual printed result will be uniform throughout the width of the press.

SUBJECT MATTER OF THE PRESENT INVENTION

Briefly, the press comprises at least four printing cylinders which are mounted in bearings with projecting shafts; the means to counteract bowing of the cylinders includes at least two force-applying tension struts which engage both of the respective shaft stubs of any of the cylinders, one end of a respective strut being linked to the shaft of one cylinder and the other end of the respective strut being linked to the shaft of an adjacent cylinder. The struts are individually adjustable in their length, and extend essentially parallel to the lateral frame structure of the press. The struts are so arranged that they form closed frames, that is, the forces applied by the struts on the stub shafts of the cylinders are entirely taken up by the frame structure formed by the struts themselves.

The cylinders can be arranged in various configurations, depending on the number of cylinders of the press; in one form, four cylinders are provided, located at the corners of a square, or rectangle, so that the struts form a closed square, or rectangular clamping frame. By connecting the shaft ends of the cylinders located at a corner, resulting forces will have resulting force vectors which have a direction extending approximately in the direction from the interior cylinder, or cylinders, thus resulting in a particularly simple clamping or framing structure. The clamping force, that is, the forces required by the frame structure, further, are decreased.

The invention will be described by way of example with reference to the accompanying drawings, wherein.

A nine-cylinder offset printing press (FIG. 1) has a printing cylinder 1, four blanket or rubber cylinders 2 and four plate cylinders 3. Such types of printing presses can be used for four-color single-sided printing or for double-sided printing with the path of the paper web extending between the rubber cylinders. If double-sided printing is to be used, two of the blanket cylinders are engaged, as indicated by the dotted lines in FIG. 1. Machines which are very wide, for example a width of six plates, that is, approximately 100 inches, are particularly subject to bowing of the cylinders. When the blanket cylinders 2 are engaged with the fixed plate cylinders 3, the plate cylinders 3 will bow about the middle of the axis thereof; this results in unclear and uneven printing.

Figure 1:
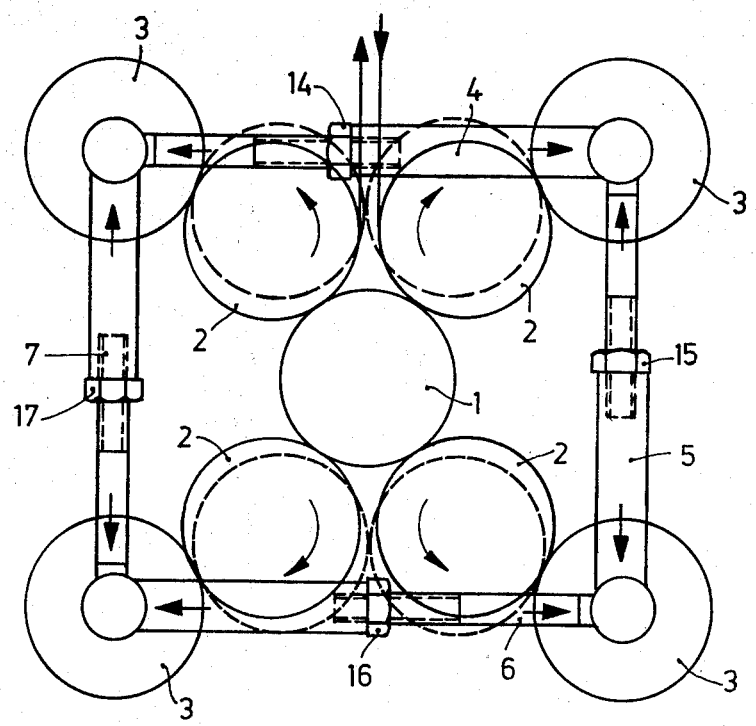
FIG. 1 is a schematic side view of an offset printing system having nine cylinders.

To prevent bowing of the plate cylinders, extension struts 4, 5, 6 are located on either side of the sidewalls 8, 9 (FIG. 5) of the machine. The length of the extension struts is individually adjustable, so as to be able to provide an individual, independent clamping or extension force on the stub shaft ends of the respective cylinder. The resulting vector force of the forces acting on the stub shafts of the cylinder extends approximately in the direction of the force applied by the rubber cylinder, or cylinders 2 when engaged with the respective plate cylinder 3. As seen in FIG. 1, and as also schematically seen in FIG. 5 where only one of the struts 4 is illustrated, the struts 4, 5, 6, 7 form a closed, square frame. The framework is located essentially parallel to the respective sidewall 8, 9 of the machine. Preferably, the struts are located outside, that is, beyond the respective bearing 10, 11, with which the plate cylinder 3 is retained in the respective sidewall. If the frames are located inside of the sidewalls, then tension members rather than extension or compression struts need be used. The strut at the right side, adjacent sidewall 9 and shown at 4', corresponds to strut 4 at the left side of FIG. 5.

The struts 4–7 are formed in two sections, with adjustments nuts 14, 15, 16, 17 engaging a threaded portion of one of the two-part struts. By extending the length of the respective strut, forces, as schematically indicated by the heavy arrows in the struts are applied against the respective stub shaft ends of the respective plate cylinder 3, which forces counteract bowing forces applied by the blanket or rubber cylinders 2. The forces can be adjusted so as to have a resultant vector direction which is at least approximately similar to the forces applied by the blanket cylinders 2.

Figure 6:
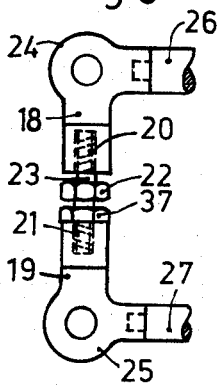
FIGS. 6 to 9 are schematic side views illustrating various embodiments of extension strut members to provide clamping forces being applied to the stub shafts of the respective cylinders of the printing press.

The struts themselves may be constructed in various ways, some of which are shown in FIGS. 6–9. A simple arrangement is shown in FIG. 1, in which bearing nuts are threaded on a threaded portion of a two-component strut; a similar, and also simple arrangement is shown in FIG. 6 in which a strut is formed of two elements 18, 19; the respective strut is internally tapped, the internal threads 20, 21 being oppositely pitched so that a bolt having right-hand threads and left-hand threads, at respective ends, can be threaded into the struts and, upon rotation of bolt 23 by means of an operating nut 22, the end distance between the struts 18, 19 can be adjusted. Each one half of the struts 18, 19 is connected to a head 24, 25, respectively, to which the strut half extending to the next adjacent strut is secured, projecting at an angle of 90° from the first strut 18, 19. Struts 26, 27 can then, in all respects, be similar to struts 18, 19, and can be connected to a similar assembly at the other side of the square, or rectangle forming the frame. A counter-nut 37 is provided to lock the struts in position. All of the struts of the square frame can be similar, and are individually adjustable, so that the undesired bowing of any of the plate cylinders 3 can be counteracted.

Figure 5:
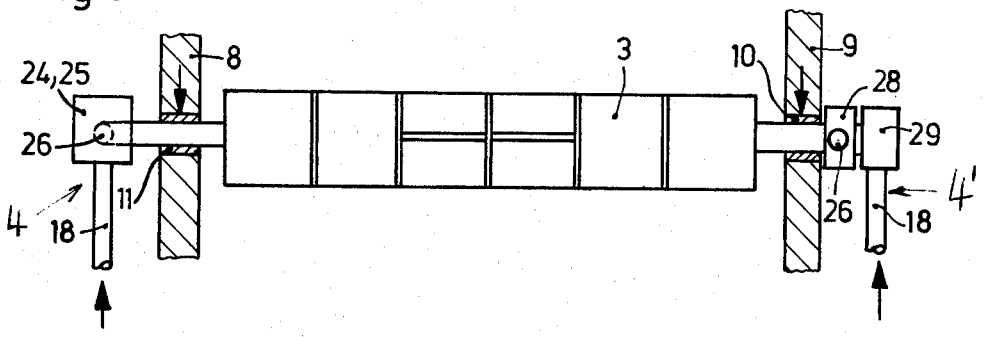
FIG. 5 is a front view schematically illustrating a cylinder located at a corner.
Figure 7:
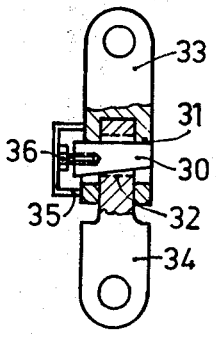
Figure 8:
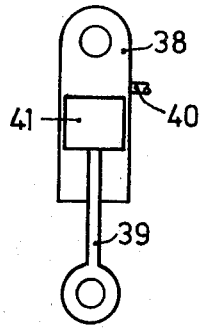

Rather than forming combined heads 24, 25, as seen in FIG. 6, or on the left side of FIG. 5, adjacently located terminal heads 28, 29 (seen on the right side of FIG. 5) may also be used. Other ways to provide for extension forces by means of frame struts can be constructed; FIG. 7 illustrates two strut elements 33, 34 formed with longitudinal slits 31, 32 in which a wedge-shaped clamping and stretching element 30 is introduced. The wedge 30 is held in position by a screw 36 extending through a frame 35 secured to the strut element 33, for example by welding. FIG. 8 illustrates extension strut elements 38, 39, forming a pressure fluid extension system in which strut element 38 forms a hydraulic cylinder, and strut element 39 is connected to a piston 41; hydraulic pressure fluid is introduced through a hydraulic control stub connection 40. This solution has the advantage of accurate, reliable control, since the pressure of the hydraulic fluid through line 40 can be easily controlled.

Figure 9:
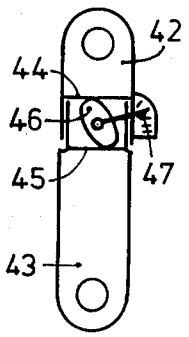

The strut elements 42, 43 illustrated in FIG. 9 are separated from each other by a cam element 46, bearing against end surfaces 44, 45, respectively. The cam element 46 forms an eccenter, which is adjustably rotatable, the position of the eccenter being indicated by a pointer 47 bearing against the scale. The position of the eccenter itself can be determined by means of suitable locking arrangements, such as lock nuts or clamping nuts.

Other equivalent clamping and extension arrangements by which struts in a closed frame can be mutually extended, may be used.

Figure 2:
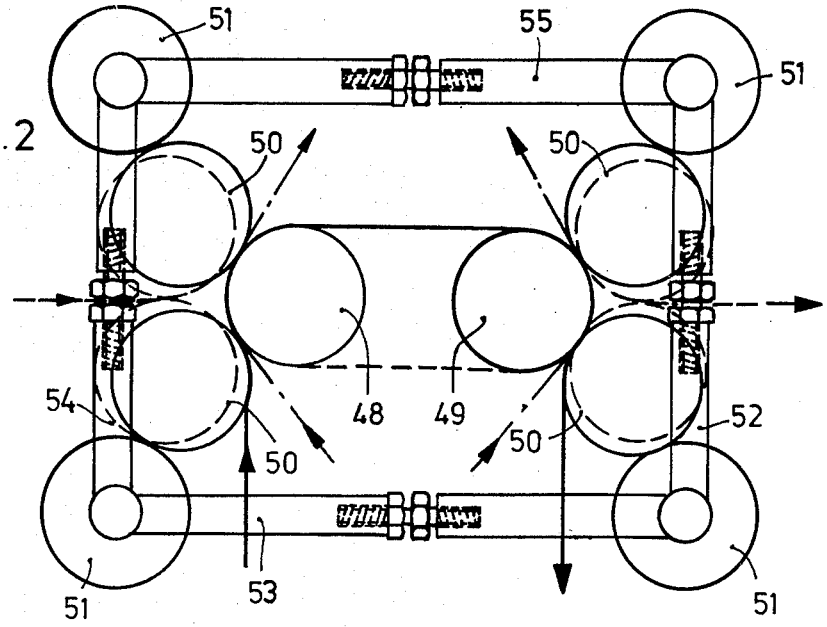
FIG. 2 is a schematic side view of a ten-cylinder offset printing system.

FIG. 2 illustrates a ten-cylinder rotary offset printing machine, in which two printing cylinders 48, 49 are respectively engaged by rubber, or blanket cylinders 50. Four plate cylinders 51 are provided. The rubber cylinders 50 can be rocked in position; the plate cylinders 51, as well as the printing cylinders 48, 49 are fixed in position in the frame. Various arrangements of guiding the paper web are possible, namely 2 × 1/1, 2 × 0/2 or 2/0, 1/3 or 3/1, 2/2, 0/4 or 4/0; one or two paper web paths are possible. Again, the shaft ends of the four-plate cylinders 51 are stressed by a rectangular frame formed of extension struts 52, 53, 54, 55, one each frame being located at a respective sidewall of the printing press, in order to apply bowing or bending forces on the respective plate cylinder stub shafts.

Figure 3:
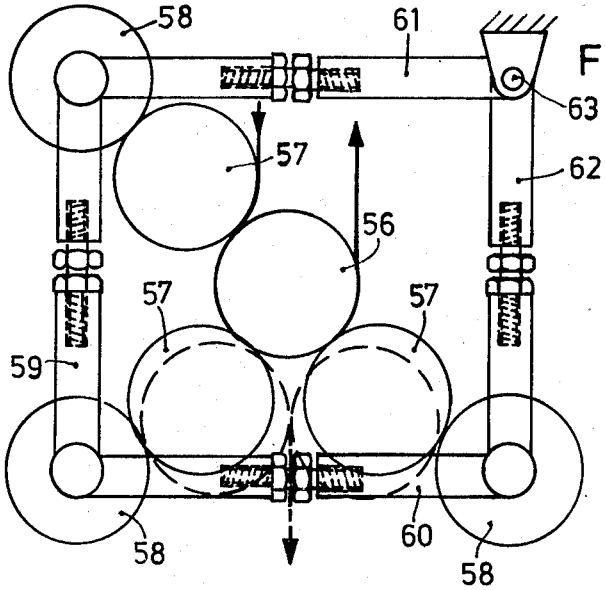
FIG. 3 is a schematic side view of an offset printing system having seven cylinders.
Figure 4:
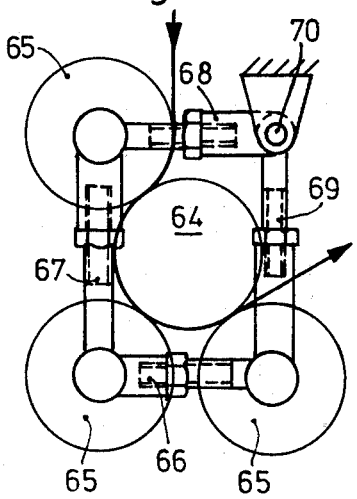
FIG. 4 is a schematic side view of a printing system similar to FIG. 3 but having four cylinders.

FIGS. 3 and 4 illustrate printing arrangements which are non-symmetrical with respect to the central plane thereof; FIG. 3 illustrates a seven-cylinder offset printing press, and FIG. 4 a four-cylinder raised printing system. Three blanket cylinders 57 are located about a printing cylinder 56, with which three plate cylinders 58 are associated. The plate cylinders 58 are connected by respective struts 59, 60. To form the closed rectangular frame, additional struts 61, 62 are provided which, in turn, bear against a fixed pin 63, functionally replacing the stub shaft at the respective corner, in FIGS. 1 and 2, and located and retained in the sidewall of the machine to form a fixed bearing point. Such a cylinder arrangement, as known, is used for three-color one-sided printing, or, if the rubber cylinders are swung or rocked against each other, for two-color printing on one side, or single-color printing on both sides of a web. Struts 59–62 may have any one of the forms illustrated in FIGS. 1 or 6–9.

The extension frames may be used not only in offset printing machines, but also in relief or impression printing machines, such as raised letterpress machines. FIG. 4 illustrates an example of a raised letterpress which corresponds, essentially, to the offset machine in FIG. 3; the rubber, or blanket cylinders then are eliminated, and the number of cylinders in the machine is limited to three plate cylinders 65 which engage a printing or counter cylinder 64, the position of which within the frame is adjustable, for example by rocking about an axis parallel to the center axis of cylinder 64, but laterally and vertically offset with respect thereto (with respect to FIG. 4). The ends of the shaft of plate cylinders 65 are tensioned with respect to each other by struts 66, 67; the struts 68, 69 tension the position of the oppositely located cylinder 65 with respect to a fixed bearing pin 70 located in the respective sidewall of the frame of the printing press, similar to the arrangement illustrated in FIG. 3.

The tensioning arrangement to prevent bowing of the respective cylinders 3 (FIG. 1) and 51 (FIG. 2) may, of course, also be used in presses having such cylinder arrangements and using raised printing systems, in which four plate cylinders rotate about one printing cylinder, or two plate cylinders cooperate with two printing cylinders, respectively. The closed rectangular frame, engaging the shaft ends of the plate cylinders, will be similar to the frame illustrated in connection with FIGS. 1 and 2, and the inventive concept, as shown, is not restricted to the particular type of printing method being used by the printing machine but, rather, is directed to preventing bowing of a cylinder used in a printing apparatus and in engagement with another one.

Various changes and modifications may be made and features described in connection with any one embodiment may be applied, equally, to other embodiments, within the inventive concept.

We claim:

1. Printing press having two lateral spaced frame structures (8, 9), a plurality of printing cylinders located between and supported by said frame structures and having their axes located at corners of a rectangle, at least four bearings mounted in each of said frame structures at the corners of said rectangle, at least four stub shafts mounted in said bearings, at least some of said stub shafts supporting the printing cylinders between said frame structures, said shafts being retained in said bearings;

and means counteracting bowing of the cylinders comprising four force-applying struts (5, 6, 7, 8; 52, 53, 54, 55; 59, 60, 61, 62; 66, 67, 68, 69) forming closed rectangular extension frames, each extension frame being located adjacent and parallel to a respective frame structure (8, 9) two struts engaging each shaft located in a respective bearing, one end of the two respective struts being connected to the shaft in the bearing at one corner and the other ends of the respective struts being linked to the shafts in the bearings at adjacent corners of the rectangle, said struts being of individually adjustable length and extending essentially parallel to the lateral frame structure (8, 9), whereby changing the length of a strut causes a force to be exerted on the stub shaft which counter balances the bowing of the cylinder mounted thereon.

2. Press according to claim 1, wherein (FIGS. 3, 4) one of the stub shaft forms an attachment pin (63, 70) for connection thereto of two struts, (59, 60, 61, 62; 66, 67, 68, 69) the cylinders being located non-symmetrically between said frame structures with respect to a plane passing vertically through said frame structures, the fixed bearings and said pins being located with respect to the location of the bearings on the frame structure retaining the cylinders and their stub shafts to form a corner point of said rectangular frame.

3. Press according to claim 1, wherein the stub shafts extend outside of said frame structure (8, 9) and the struts are located outside of the frame structures (8, 9), and the struts are extension struts applying pressure forces.

4. Press according to claim 1, wherein each strut (5, 6, 7, 8, 52, 53, 54, 55, 59, 60, 61, 62, 66, 67, 68, 69) comprises two parts, and a tensioning means (14, 15, 16, 17) located between said parts.

5. Press according to claim 1, wherein each strut is formed with a tapped bore (20, 21) and a tensioning bolt (23) is screwed into said bores connecting said parts, the threads on opposite end portions of the bolt and in the respective bores being pitched in opposite direction to permit separation of said parts upon rotation of the bolt.

6. Press according to claim 1, wherein the struts comprise two parts (33, 34), and a wedge means (30) is provided, separating said parts by an adjustable distance upon introduction of the wedge means between said parts.

7. Press according to claim 1, wherein the struts comprise two parts (42, 43) and a rotatable cam is located between said parts which, upon rotation, changes the relative length of said struts.

8. Press according to claim 1, wherein said struts (38, 39) comprise a pressure fluid extension system to adjust their respective lengths including a pressure fluid cylinder-piston combination (41).

9. Press according to claim 1, wherein each strut is formed with an end head (28, 29) engaging a respective shaft of a cylinders.

10. Press according to claim 1, wherein the struts are two-part elements, and two struts are joined by a single head, said head engaging the shaft, the parts of said struts being relatively angled with respect to each other by 90°.

* * * * *